US005464149A

United States Patent [19]

Fowler et al.

[11] Patent Number: 5,464,149

[45] Date of Patent: Nov. 7, 1995

[54] H-PARTITION AND DISPLAY CASE

[75] Inventors: Kimberly A. Fowler, Lutherville, Md.; Lisa E. Feustle, Chester, England

[73] Assignee: Lever Brothers Company, New York, N.Y.

[21] Appl. No.: 174,742

[22] Filed: Dec. 29, 1993

[51] Int. Cl.[6] ..... B65D 25/04

[52] U.S. Cl. ..... 229/120.27; 229/120.38

[58] Field of Search ..... 229/120.24, 120.26, 229/120.27, 120.29, 120.38, 241; 206/561

[56] References Cited

U.S. PATENT DOCUMENTS 2,596,205 5/1952 Buttery .
3,347,356 10/1967 Kossnar .
3,982,684 9/1976 David .
4,164,312 8/1979 Harned .
4,282,999 8/1981 Moen .
4,946,042 8/1990 Ferrari .
5,156,276 10/1992 Lebowitz .

*Primary Examiner*—Allan N. Shoap
*Assistant Examiner*—Christopher T. McDonald
*Attorney, Agent, or Firm*—Gerard J. McGowan

[57] ABSTRACT

A "H" partition and blank therefor to divide the products in a carton, particularly a display carton having a window. The partition includes a window which facilitates visual and physical access through the window in the display case to products in the rear of the carton, particularly when access is through the front of the carton.

26 Claims, 3 Drawing Sheets

H-PARTITION AND DISPLAY CASE

BACKGROUND OF THE INVENTION

Household products are frequently displayed for purchase in the cases in which they are shipped. This avoids the need to unpack the case and place the products on the shelves. It also provides an opportunity to place attractive advertising matter on the case where it will be seen by consumers at the point of purchase. However, if this approach is to be used, it is desirable that the goods be readily seen once the display case has been opened. Ferrari et al. U.S. Pat. No. 4,946,042 discloses a shipping and display case. Lebowitz U.S. Pat. No. 5,156,276 and Kossner U.S. Pat. No. 3,347,356 also disclose display cartons.

Partitions are generally employed in display and other cases to divide the products and provide support for the case. Depending on the ultimate use of the case, the partitions may take various forms. For instance, partitions in the form of an "H" have been used. Prior partitions can be seen from Harned U.S. Pat. No. 4,164,312, Moen U.S. Pat. No. 4,282,999 and David U.S. Pat. No. 3,982,684. Buttery U.S. Pat. No. 2,596,205 is directed to a partitioned tray.

A difficulty encountered with the use of previous "H" partitions and display cartons is that even when the display carton has been opened, it is difficult to see all of the product and to remove all of the product behind the partition. Particularly is this a problem where it is desired to open the front of a carton while cartons or other objects remain stacked on top. Even where the carton permits opening from the front once products in front of the central panel of the H-divider are removed, visual and physical access to the product behind the central panel is impaired or impossible.

SUMMARY OF THE INVENTION

The invention is directed to a new "H" partition, a blank for preparing such a partition and to a combination display case and partition. The partition of the invention includes a central wall having two ends, a transversely extending wall at each end and an opening in the central wall permitting visual access through the wall from a first side of the wall to a second side of the wall. Preferably the opening extends to at least a portion of a top edge of the wall. More preferably the opening is U-shaped and is centrally disposed within the central wall.

The blank of the invention includes a central wall, lines of weakness dividing the central wall into two panels and an opening in the central wall. The central wall panels are preferably each joined to at least one end panel. Preferably the opening includes a removable panel. The removable panel may be attached to the one or both of the central panels by lines of weakness and the lines of weakness may be perforated lines or partially cut scorelines.

The "H" partition is preferably used in combination with a shipping and display carton having lines of weakness defining a display panel which may be removed to form a display opening. Preferably at least a portion of the display opening is at the front of the carton.

For a more complete understanding of the above and other features and advantages of the invention, reference should be made to the following detailed description of preferred embodiments and the accompanying drawings.

DETAILED DESCRIPTION OF THE INVENTION

Figure 1:
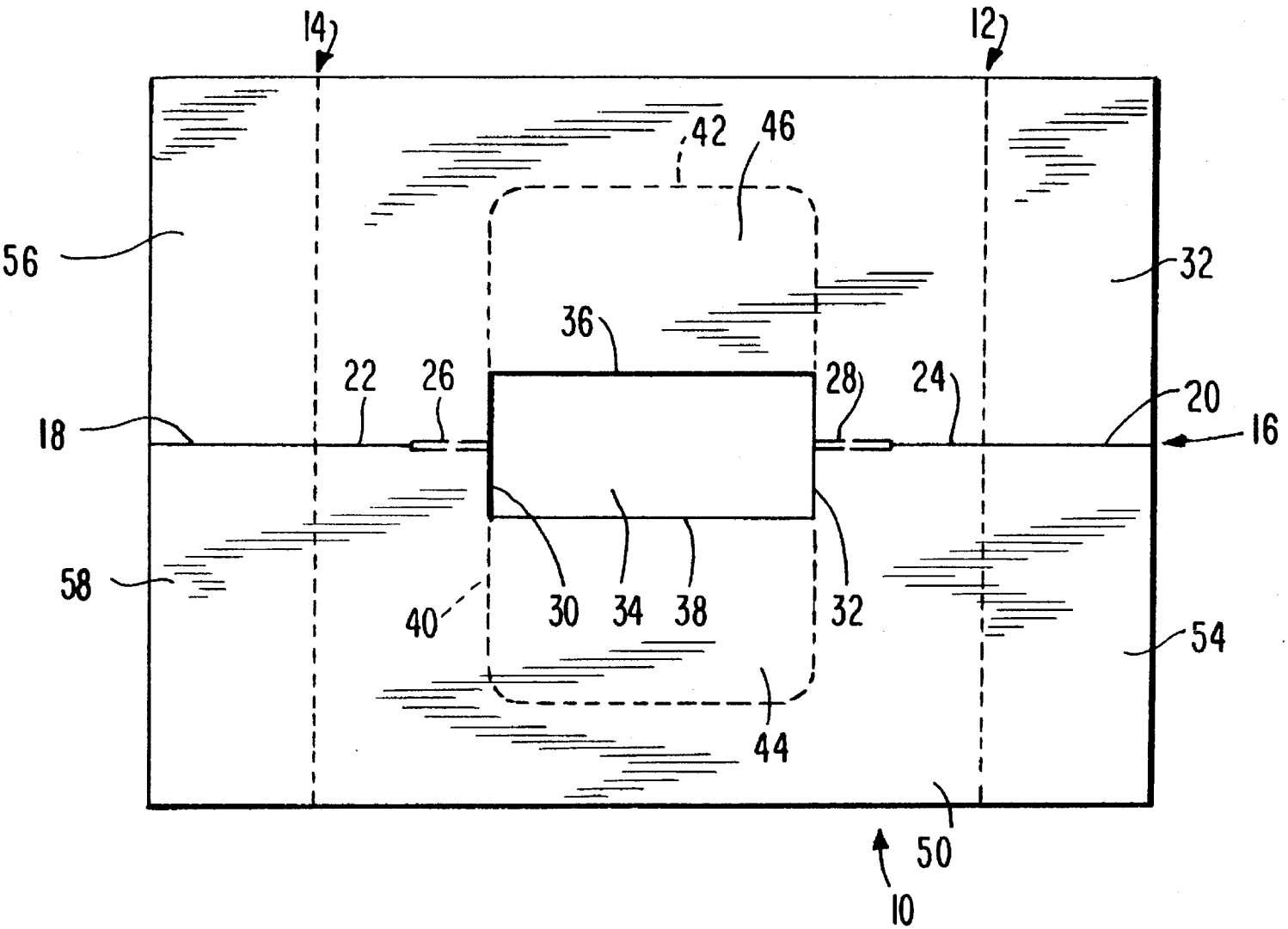
FIG. 1 is a top plan view of a blank of the invention useful for making the "H" divider.

Referring to FIG. 1, divider blank 10 includes transverse scorelines 12 and 14 and longitudinal axis 16. Scorelines 12 and 14 may be cut score lines or partially cut score lines (e.g., ¼" cut followed by ¼" score). Longitudinal axis 16 comprises fully cut scorelines 18 and 20 distal to transverse folding scorelines 14 and 12 respectively, partially cut scorelines 22 and 24 immediately medial to scorelines 14 and 12 and enlarged cut scorelines 26 and 28 medial to the partially cut scorelines. Scorelines 26 and 28 may be present as illustrated in FIG. 1 as pairs of scorelines spaced 3/16" apart from each other to create one larger score for ease of fold over. 26 and 28 intersect and extend perpendicularly to lines 30 and 32 which define lateral edges of opening 34. Upper and lower edges of opening 34 are defined by lines 36 and 38. U-shaped perforated scorelines 40 and 42 extend from lines 32 and 30 to define removable panels 44 and 46.

Scorelines 12 and 14 define a central wall-forming panel 50. Distal to central panel 50, folding scoreline 12 is divided by cut scoreline 20 into end panels 52 and 54, while the region distal to scoreline 14 is divided by cut scoreline 18 into end panels 56 and 58.

Figure 5:
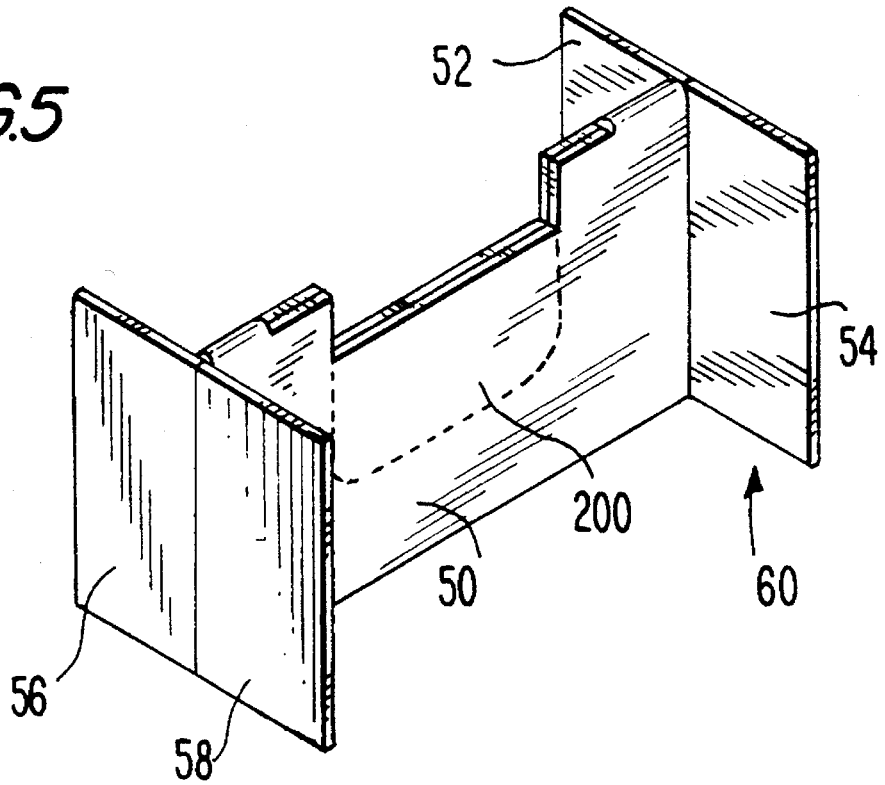
FIG. 5 is a perspective view of the "H" divider of the invention prior to removal of a removable panel.

Blank 10 is erected into H-divider 60 as seen e.g. in FIG. 5 by folding the blank along axis 16 so that the surfaces of each half of the central panel are coextensive and one side of end panel 52 is coextensive with that of 54 and one side of end panel 56 is coextensive with that of end panel 58. Then, end panels 52, 54, 56 and 58 respectively are folded away from and at a 90° angle to axis 16. The resulting H-shaped divider can be seen in FIG. 5. Abutting surfaces of each half of the central panels may be adhered together as by hot melt or a chemical adhesive.

Figure 3:
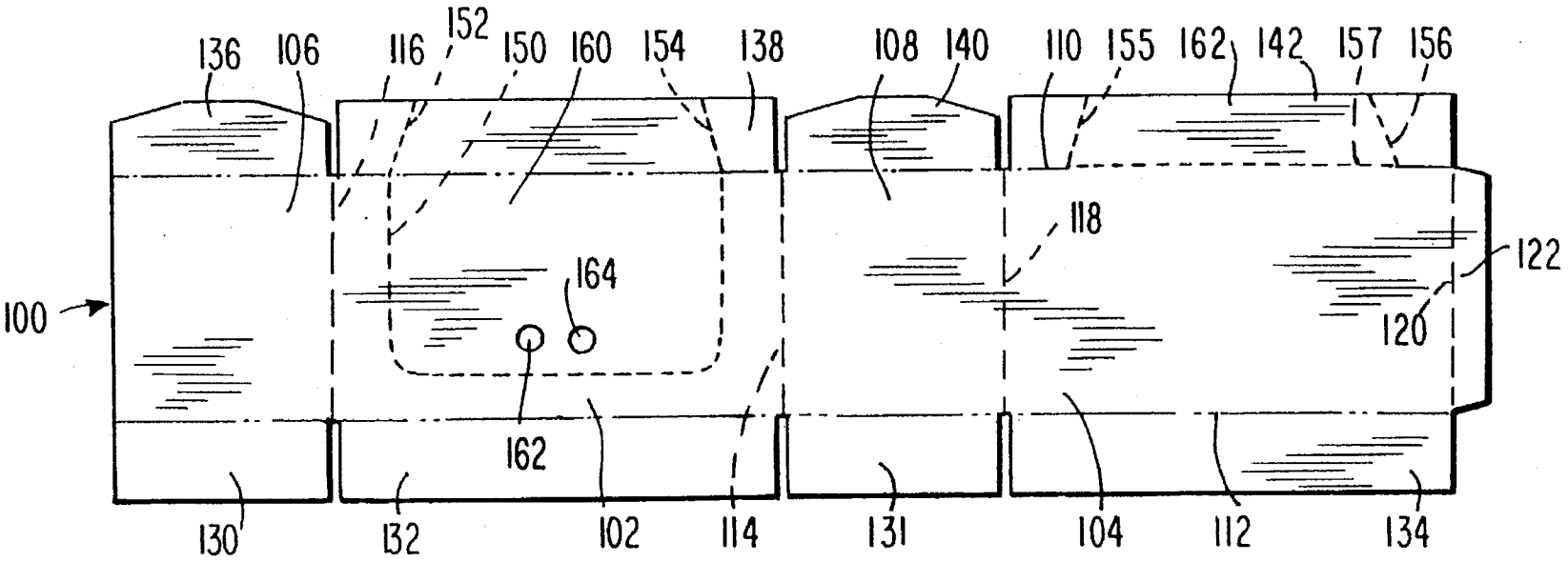
FIG. 3 is a top plan view of a blank for forming a display case with which the "H" divider of the invention may be used.
Figure 4:
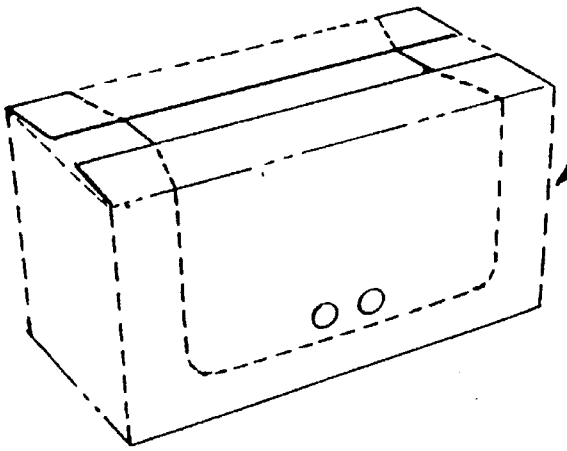
FIG. 4 is a perspective view of the erected display carton of FIG. 3.

The H-shaped divider of the invention is suitable for use with a display carton such as that shown in FIG. 4, which may be fabricated from a carton blank such as that shown in FIG. 3. The blank of FIG. 3 and the display carton of FIG. 4 are similar to those known in the prior art.

Blank 100 of FIG. 3 comprises front panel 102, rear panel 104 and side panels 106 and 108. Each of the panels is defined in part by top scorelines 110 and bottom scorelines 112. Front panel 102 is further defined by transverse scorelines 114 and 116. Rear panel is further defined by transverse scorelines 118 and 120. Side panel 108 is further defined by scorelines 114 and 118 and side panel 106 is further defined by scoreline 116. Transverse scoreline 120 separates rear panel 104 from glue flap 122.

Bottom scoreline 112 separates respectively bottom minor flap 130 from side panel 106, bottom major flap 132 from front panel 102, bottom minor flap 131 from side panel 108 and bottom major flap 134 from rear panel 104. Top scoreline 110 separates respectively top minor flap 136 from side panel 106, top major flap 138 from front panel 102, top minor flap 140 from side panel 108 and top major flap 142 from rear panel 104.

Front panel 102 includes a generally U-shaped partially cut scoreline 150. Scoreline 150 extends at each of its ends through upper major flap 138 at lines 152 and 154 respectively. Upper major flap 142 includes perforated scorelines 155 and 156, and also scoreline 157, which is coextensive with longitudinal scoreline 110 and extends between scorelines 155 and 156. Scorelines 150, 152 and 154 together define removable panel 160. Scorelines 155, 156 and 157 define a removable flap 162. Removable panel 160 includes grasping apertures 162, 164, although these are optional and need not be present.

The carton is erected by adhering, by gluing or otherwise glue flap 122 to side panel 106, folding flaps 130 and 131 perpendicular to side panels 106 and 108, applying glue to flaps 130 and 131, and folding bottom major flaps 132 and 134 perpendicular to panels 102 and 104 over flaps 130 and 131 to glue them shut. The H-shaped divider 60 is then placed in the carton after which the product to be contained within the carton is placed therein. Typically, the divider might be used to divide six liquid detergent containers into two sides of three apiece. Flaps 136, 140 are then folded perpendicular to side panels 106 and 108, glue is applied, and major flaps 138 and 142 are folded over flaps 136, 140 perpendicular to panels 102 and 104, to glue the flaps shut to produce carton 170 shown in FIG. 4.

In operation, the product contained within display 170 will be shipped to its location of sale. When it is desired to display the product, the opening panel 160 is grasped by apertures 162, 164 and removed. In the event that it is desired to open a display carton which still has cartons or other items stacked thereon, only that portion of opening panel 160 which is disposed in the plane of front panel 102 will be removed, thereby exposing product in front of wall 50 of H-shaped divider 60. An additional line of weakness may be provided in panel 160 along scoreline 110 between lines 152 and 154 for this purpose if desired.

Figure 2:
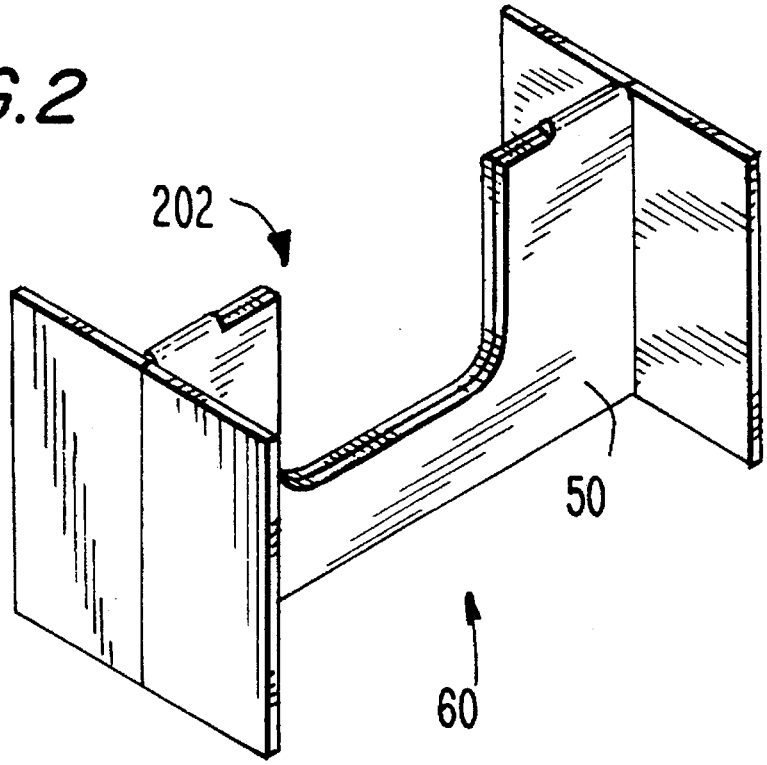
FIG. 2 is a perspective view of the "H" divider of the invention.

Since the product may not be seen from the top, it is desirable that it be seen when viewed from the side through the opening created in the display carton. To this end, opening wall 200 (FIG. 5) comprising opening panels 44 and 46 may be removed from the wall 50 of divider 60 whereby a U-shaped opening 202 is created. Product behind wall 50 can readily be seen and removed through opening 202 (FIG. 2). If instead it is desired to remove the top of the display carton 170, the remainder of opening panel 160, which includes the portion of flap 138 between lines 152 and 154 is removed, as is opening portion 162 of flap 142. In this way, the product can be viewed from the top where there is no carton stacked above it. Here too, removal of opening wall 200 will improve visual and physical access to the product.

The carton and divider may be made of any suitable material, including corrugated fiberboard. The "H" divider is sturdy, provides good compressive strength, and yet admits of ready display of the product even from the side. The presence of opening panels 46 and 44 prior to their removal further improves the strength of the H-shaped divider. The divider is very readily assembled. Removal of the opening panel facilitates removal of bottles in the back row of the carton behind the divider wall 50.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. An H-shaped divider comprising a) a central wall having two ends and two sides, b) a transversely extending end wall at each end of said central wall extending transversely on both sides of said central wall, c) said central wall having an opening permitting visual access from a first side of said wall to a second side of said wall, said opening including a removable panel.

2. The divider of claim 1 wherein said central wall includes a top edge and a bottom edge and said opening extends to at least a portion of said top edge.

3. The divider of claim 2 wherein said opening is U-shaped.

4. The divider of claim 3 wherein said opening is spaced from said ends of said central wall.

5. The divider of claim 4 wherein said opening is centrally disposed within said central wall.

6. The divider of claim 5 wherein at least one of said transversely extending end walls is comprised of first and second panels.

7. The divider of claim 6 wherein said first and second panels are disposed respectively on said first and second side of said central wall.

8. The divider of claim 1 wherein said removable panel is attached to said central wall by lines of weakness.

9. The divider of claim 8 wherein said lines of weakness are perforated lines.

10. The divider of claim 8 wherein said lines of weakness are scorelines partially cut through.

11. The divider according to claim 1 wherein said central wall comprises two panels folded so that their surfaces are generally coextensive on one side.

12. A blank adapted to form an H-shaped divider comprising a) a central wall, b) lines of weakness dividing said central wall into two panels, c) an opening in said central wall, d) each of said panels being joined to at least one end panel by a scoreline transverse to the lines of weakness, e) at least one of said panels including a removable panel adjoining said opening.

13. The blank according to claim 12 wherein said panels comprising the central wall each includes a free edge on the side opposite said lines of weakness and said opening is spaced from said free edges.

14. The blank of claim 12 wherein said opening is generally rectangular.

15. The blank of claim 12 wherein said opening is centrally disposed within said central panel.

16. The blank of claim 12 further wherein each of said central panels includes two ends and wherein each of said central panels includes an end panel at each end.

17. The blank of claim 12 wherein said removable panel is attached to said central panel by lines of weakness.

18. The blank of claim 17 wherein said lines of weakness are perforated lines.

19. The blank of claim 17 wherein said lines of weakness are partially cut-through scorelines.

20. A combined display carton and H-shaped divider comprising an H-shaped divider including a) a central wall having two ends and two sides, and b) a transversely extending end wall at each end of said central wall extending transversely on both sides of said central wall, c) said central wall having an opening permitting visual access from a first side of said wall to a second side of said wall, said opening including a removable panel.

21. The combined display carton and H-shaped divider of claim 20 wherein at least a portion of the front panel of the display carton is removable to display the product.

22. An H-shaped divider comprising a) a central wall having two ends and two sides, b) a transversely extending end wall at each end of said central wall extending transversely on both sides of said central wall, c) said central wall having a removable panel positioned so that upon removal an opening is formed affording visual access from a first side of said wall to a second side of said wall.

23. The divider of claim 22 wherein said central wall includes a top edge and a bottom edge and said removable panel extends to at least a portion of said top edge.

24. The divider of claim 23 wherein said removable panel is U-shaped.

25. The divider of claim 23 wherein said removable panel is spaced from said ends of said central wall.

26. The divider of claim 22 wherein said removable panel is attached to said central wall by lines of weakness.

* * * * *